United States Patent [19]

Fox et al.

[11] 4,260,528

[45] Apr. 7, 1981

[54] AQUEOUS HIGH VISCOSITY LIQUID DISHWASHER COMPOSITIONS

[75] Inventors: Daniel J. Fox; David Van Blarcom, both of Hawthorne; Fred K. Rubin, Leonia, all of N.J.

[73] Assignee: Lever Brothers Company, New York, N.Y.

[21] Appl. No.: 49,996

[22] Filed: Jun. 18, 1979

[51] Int. Cl.[3] ..... C11D 3/32

[52] U.S. Cl. ..... 252/525; 252/139; 252/153; 252/174.17; 252/174.18; 252/174.24; 252/544; 252/DIG. 14

[58] Field of Search ..... 252/174.17, 174.18, 252/174.23, DIG. 14, 139, 153, 525, 544, 174.24

[56] References Cited

U.S. PATENT DOCUMENTS

| | | | |
|---|---|---|---|
| 2,773,835 | 12/1956 | Anderson | 252/153 |
| 2,920,045 | 1/1960 | Hearn et al. | 252/DIG. 14 X |
| 2,947,702 | 8/1960 | Coskie | 252/DIG. 14 X |
| 2,992,993 | 7/1961 | Pengilly | 252/DIG. 14 X |
| 3,060,124 | 10/1962 | Glnn | 252/174.18 X |
| 3,175,977 | 3/1965 | Smithson et al. | 252/544 |
| 3,320,173 | 5/1967 | Minor | 252/525 |
| 3,755,206 | 8/1973 | Verdier | 252/153 X |
| 3,812,042 | 5/1974 | Verdier | 252/DIG. 14 X |
| 4,162,987 | 7/1979 | Maguire et al. | 252/135 |

FOREIGN PATENT DOCUMENTS 1031229 5/1978 Canada .

*Primary Examiner*—Harris A. Pitlick

*Attorney, Agent, or Firm*—James J. Farrell; Melvin H. Kurtz

[57] ABSTRACT

A liquid dishwasher composition is disclosed with sufficiently high viscosity for convenient use and good flow properties. The composition contains a natural, biopolymeric or synthetic gum thickener and a polyhydric alcohol and urea for viscosity and flow control.

9 Claims, No Drawings

AQUEOUS HIGH VISCOSITY LIQUID DISHWASHER COMPOSITIONS

BACKGROUND OF THE INVENTION

This invention relates to the field of liquid detergent compositions suitable for use in automatic dishwashers.

Compositions for use in automatic dishwashers are formulated with different objectives than other types of detergents. The chief objectives are the removal of food soils, the removal of stains, and the destruction of bacteria.

The removal of food soils is both mechanical and physico-chemical in nature and is influenced by a number of factors among which are wetting, emulsification, adhesion of soil to substrate, soil suspension, alkalinity, anti-flocculation and foam control. Wetting and emulsification can be achieved with many common surfactants, but other considerations must be taken into account. The removal of soils is best effectuated with large amounts of builder and high pH. In order to increase the pH, large amounts of highly alkaline inorganic salts such as hydroxides, carbonates and metasilicates are present, which cause the saponification of fatty soils. This high pH-surfactant system is assisted by vigorous mechanical action. Protein soils have a tendency to foam under this heavy mechanical action and this foam impedes the mechanical cleaning action of the dishwasher and may cause the machine to overflow. In order to minimize foaming, certain low foaming surfactants are chosen to formulate dishwasher compositions and foam suppressants may be added.

Dishwasher detergents generally take the form of free flowing powder granules which are dispensed from cups which are built into most machines. Due to the high pH and frangibility of these powders, dusty fines are often produced which can cause sneezing, eye irritation and dermatitis. These powders tend to cake when exposed to air for long periods of time and become less soluble after aging; due to absorption of carbon dioxide from the air, the pH drops converting some of the silicate to insoluble silica. This reduced solubility often results in grittiness and spotting of washed articles.

Liquid dishwasher detergents have not thus far been commercialized for home use. The ideal liquid dishwasher detergent must be dispensible from the means currently installed in dishwashers for dispensing powders. This requires that such a liquid have a fairly high viscosity so that it will not run out of a loosely sealed dispensing cup meant for powders, when the dishwasher door is closed. Ordinary hand dishwashing liquids have low viscosity and high foam and are thus unsuitable. The ideal product, despite its high viscosity, must flow easily so that it may be dispensed from a tube or plastic squeeze bottle. The product must also completely dissolve in water very quickly and must not separate upon standing.

In order to achieve viscosities as high as are desired in a system such as this, it is useful to use thickening agents. However, the other system parameters, the high pH and high electrolyte content make the use of a thickening agent difficult, since thickening agents generally do not remain stable under these conditions. In addition, in gum thickened systems of very high viscosities, it is difficult to attain satisfactory flow properties, the result often being a stringy or gummy mass.

RELATED ART

Liquid dishwasher detergents in pasty, gel-like or viscous forms are mentioned in U.S. application Ser. No. 699,416 filed Aug. 2, 1976 now abandoned (Netherlands Pat. No. 7,706,942). This application suggests adding thixotroping agents to aqueous solutions of the described composition; agents mentioned include cellulosics, colloidal silica, clay, starch, gelatin and polyvinyl pyrrolidone. It has been the experience of applicants that cellulosics and silicas will not remain stable for long periods of time in solutions containing high electrolyte levels.

Canadian Pat. No. 1,031,229, May 16, 1978, discloses a liquid dishwasher composition containing a thickener, a surfactant and water. The thickener is broadly disclosed and a statement is made that virtually any conventional aqueous system thickener may be used. The thickener in a preferred embodiment is sodium carboxymethylcellulose.

U.S. Pat. No. 2,992,993 describes a viscous opaque liquid detergent, viscosity controlled by the addition of ethyl alcohol and a polyhydric alcohol (glycerol) in a critical ratio. Urea is mentioned as an additive, but no reason is given for its addition.

U.S. Pat. No. 3,812,041 discloses the addition of thickeners to a heavy duty liquid detergent.

U.S. Pat. No. 3,812,042 discloses a light duty liquid detergent containing an aliphatic alcohol and urea as viscosity regulating agents.

U.S. Pat. No. 3,935,129 describes an aqueous liquid cleaning "system" containing urea and glycerin, along with an anionic detergent, a nonionic detergent, triethanolamine and optionally, sodium silicate. The compositions are nonthickened and are presumably of low viscosity. No compositions are mentioned for use as dishwasher detergents, and the composition which is closest in proportion (but not in materials) to the instant composition, Example 3, is used as a laundry detergent. No function is defined for the urea or glycerin.

U.S. Pat. No. 2,773,835 describes a low pH shampoo containing urea as a stabilizer. Glycerin is an optional ingredient.

U.S. Pat. No. 2,920,045 describes a liquid detergent in the form of a thixotropic suspension having a viscosity of 50 to 5,000 cps. Urea is added to prevent the formation of a gel.

U.S. Pat. No. 2,947,702 discloses a liquid detergent composition containing urea, ethanol, and certain hydroxyl acids as solubilizing agents. These compositions also contain sodium dodecylbenzene sulfonate and potassium pyrophosphate.

SUMMARY OF THE INVENTION

It has been discovered that standard low foaming surfactants, builders, and alkalinity agents may be used to formulate a liquid automatic dishwasher detergent of high viscosity, good stability and excellent flow properties. Thickening action is provided by the addition of certain types of thickeners among which are natural and biopolymeric gums and chemical derivatives thereof; stability and flow are controlled by the addition of critical amounts of urea and polyhydric alcohol and adjustment of pH.

DESCRIPTION OF THE INVENTION

The compositions of the instant invention are liquid automatic dishwasher detergents having a viscosity of about 13,000 to about 150,000 cps and a pH of about 11 to about 13, which in essence contain (a) a surfactant;

(b) about 10% to about 70% of at least one detergency builder;

(c) sufficient alkalinity agent to adjust the pH of the composition to 11–13;

(d) about 0.50 to about 5% of a suitable thickener;

(e) about 0.3% to about 10% of a polyhydric alcohol;

(f) about 0.5% to about 8% urea; and (g) water.

The viscosity of these compositions has been found to be a critical factor in determining their suitability for use. A viscosity of at least about 13,000 cps., as measured with a Brookfield viscometer (Model LVF, spindle #4, 6 rpm, at 25° C.) is necessary to keep the liquid detergent from running out of the dispensing cup. The maximum useful viscosity is about 150,000 cps., since above this, the liquid flows only with great difficulty and is not easily dispensed from its container. The preferred range is about 15,000 cps. to about 50,000 cps.

The surfactants which are used in the compositions of this invention are those which are normally used in machine dishwashing products. These surfactants should be of the low foaming type as foam interferes with dishwasher cleaning action. High foaming surfactants are preferably excluded or used in only minimal amounts, or if desired used with effective defoamers.

Nonionic surfactants are preferred for the compositions of this invention. While the invention is not limited to any particular type of nonionic, examples of suitable nonionics are:

1. Block copolymers prepared by adding polyoxyethylene to a polyoxypropylene chain.

2. Polyoxyalkylene ethers of aliphatic alcohols having about 8–22 carbon atoms.

3. Polyoxyalkylene esters of inorganic acids.

4. Polyoxyalkylene esters of alkylphenol.

5. Condensation products of oxyethylene and oxypropylene with ethylene diamine.

The level of nonionic in the composition may vary from about 1% to about 25%, with about 3% to about 15% the preferred range for proper foaming and cleaning.

The preferred nonionics are polyoxyethylene-polyoxypropylene block copolymers with a molecular weight of about 1500 to about 3000. Examples of these are sold under the trademark "Pluronic" by BASF-Wyandotte. Pluronic L61 has a molecular weight of about 2,000 and L62D has a molecular weight of about 2,500.

Certain low-foaming anionic surfactants may also be used to advantage in these compositions, at levels of about 0.2% to about 7.5%. Examples are:

1. alkyl diphenyloxide sulfonates 2. methyl naphthalene sulfonates 3. sodium 2-acetamidohexadecane sulfonate.

The builders used in the compositions of this invention are those well known to the detergent art. Suitable builders include alkali metal salts of polyphosphates, pyrophosphates, carbonates, citrates, nitrilotriacetates, carboxymethyloxysuccinates and polyacrylates. The builder can be used at a level of about 10% to about 70%, with about 20% to about 50% the level usually used in dishwasher products.

Two classes of gums are preferred for the compositions of this invention. The preferred gums, in addition to providing compositions which are stable and which have satisfactory flow properties, produce compositions which are desirably clear or translucent.

The first class of preferred gums is naturally occurring polysaccharide gums composed largely of polygalactomannan, and derivatives of these gums. Polygalactomannans contain as a basic unit, two mannose molecules with a glycosidic linkage and a galactose side chain attached to some of the mannose molecules. The chief examples of this class of materials are guar gum (mannose:galactose), locust bean gum (mannose:galactose ≅4–5:1), the carboxymethyl derivatives of guar and locust bean gums, and the hydroxyalkyl derivatives of guar and locust bean gums. A description of plant gums can be found in the *Kirk-Othmer Encyclopedia of Chemical Technology,* 2nd, Ed., Vol. 10, pp. 741 et. seq. A particularly preferred material for the compositions disclosed herein is Jaguar HP-11, a carboxy-methylated guar gum manufactured by Stein-Hall, Inc., New York, N.Y.

The second class of preferred gums useful in the invention is biopolymeric gums, produced by the microbial fermentation of sugars. Examples are:

1. Xanthan gum (also known as polysaccharide B-1459), produced by the fermentation of glucose by the microorganism Xanthomonas campestris.

2. The products of glucose fermentation with Sclerotium fungus. Such a material is "Polytran" sold by Jetco, and is a linear chain of anhydroglucose units linked $\beta$ 1–3, 30–35% of which bear single appended anhydroglucose units linked $\beta$ 1–6. The molecular weight of this material is greater than 500,000.

Among the other gums suitable for the compositions of this invention are gum tragacanth, starch, carboxymethyl starch, dextrin, and vinyl copolymers such as the polymer of methyl vinyl ether and maleic anhydride. These materials produce compositions which are opaque white.

Materials which are not suitable for this invention include gelatin, algin, cellulose derivatives such as methyl-, carboxymethyl- and hydroxyethyl-cellulose, silicas, clays and ethylene oxide polymers. These materials have insufficient stability for the systems produced.

The gum thickeners may be used individually or in combination with one another. The total gum content of the composition should be about 0.5% to about 5.0%, with about 1.25% to about 2.5% producing the optimum viscosity and flow properties.

As previously mentioned, surfactant-builder combinations thickened with the gums of this invention cannot be used without additional flow-modifying and stability agents. Without these agents, the compositions cannot be poured, but rather slip out of the container as a cohesive mass of mucous-like consistency. Also, these compositions are opaque, separate into two phases upon standing, and "oil out", that is, form an exudate.

The addition of a polyhydric alcohol such as glycerol, ethylene glycol, or propylene glycol to the compositions will cure the flow defects and prevent phase separation upon standing. Excess amounts of alcohol are to be avoided, however as they promote "string" formation—the tendency to form long threads at the end of a ribbon of paste squeezed from a container. Consequently, the level of alcohol in the composition should be from about 0.3% to about 10%, with about 0.8% to about 4.0% providing optimum viscosity. "Oiling out" of the composition is prevented by the addition of urea. Excessive urea, however, causes an increase in viscosity and turns the composition "rubbery"; it also may produce an objectionable odor. Urea should be added at a level of about 0.5% to about 8%, preferably 2.0–5.0% to provide adequate stability without objectional odor.

The optimal beneficial effect from the presence of glycerol and urea will be obtained when they are in a ratio of approximately 1:3 to 6:1 with a preferred combined concentration of about 2.5% to about 6.5%. Combinations outside these ranges will also be effective, but less so. It should be noted that based on the instant disclosures, it is within the level of skill in the art to create a product having the desired viscosity by varying the levels of gum thickener and polyhydric alcohol and determining the optimal level of urea for the particular combination.

Both glycerol and urea tend to clarify the composition, making it translucent rather than opaque.

The pH of dishwasher compositions is normally quite high, enough to provide a wash solution with a pH of 9 to 11, preferably at least 10. In the instant composition, pH may affect viscosity and flow characteristics, particularly with guar gum. The pH of the composition itself must be between about 11 and about 13 to provide a high pH wash solution, and sufficient alkalinity agent must be added to adjust the pH to the 11–13 level. Suitable alkalinity agents include sodium silicate ($SiO_2$:-$Na_2O$=about 1:1 to about 4:1) which has also been included in dishwasher products for overglaze protection, alkali metal hydroxides and alkanolamines. The level of alkalinity agent is usually about 1% to about 20%.

If desired, chlorine containing compounds may be added to the instant compositions. This is however difficult to accomplish as chlorinating agents frequently react with other ingredients of the composition when in aqueous solution. Separation of the chlorine source from the composition is therefore essential and may be accomplished in two basic ways: encapsulating the chlorine source and suspending in the liquid, or dispensing the chlorine source from a separate compartment of the product container.

The instant compositions may also contain other useful materials, well known to the art. Among these are germicides and preservatives, suds depressants (antifoams), overglaze protection agents, metal corrosion agents, colorants and perfumes.

In formulating compositions of the instant invention, while not essential, it is advantageous to predisperse the thickening agent in an organic solvent prior to addition to the composition. This predispersion method insures the homogeneity of the product. Such solvents as methanol, ethanol, isopropanol, mineral oil, propylene glycol may be used, and these will be found in the final product; a portion of the glycerol to be used in the product may also be used to predisperse the thickening agent. Homogenization of the product by high speed mixing is also advantageous and sometimes necessary, depending on the viscosity of the product.

The following examples will serve to illustrate the compositions of the instant invention. All percentages are by weight.

EXAMPLES 1–3

Dishwasher liquid detergents are made up with the following compositions:

| | 1 | 2 | 3 |
|---|---|---|---|
| Carboxymethyl Guar Gum | 1.5% | 1.5% | 1.5% |
| Ethanol | 1.5 | — | 1.5 |
| Isopropanol | — | 1.5 | — |
| Polyoxyethylene-polyoxypropylene block copolymer, MW = 2500 | 9.0 | 9.0 | 6.0 |
| Polyoxyethylene-polyoxypropylene block copolymer, MW = 2000 | 3.0 | 3.0 | 2.0 |
| Sodium Citrate Dihydrate | 18.0 | 18.0 | 18.0 |
| 8/1 Tetra K/Na Pyrophosphate | 17.0 | 17.0 | 17.0 |
| Sodium Silicate ($SiO_2$ : $Na_2O$ = 2.4) | 4.0 | 4.0 | 4.0 |
| Urea | 2.4 | 2.4 | 2.4 |
| Glycerol | 2.0 | 2.0 | 2.0 |
| Water | | to 100% | |

Performance testing of these compositions is done in the following manner, prescribed by the American Society for Testing and Materials in the "Method for Measurement of Depositions on Glassware During Mechanical Dishwashing":

10 dinner plates are uniformly soiled with a mixture of margarine and powdered milk in a 4:1 ratio. The 10 plates are placed on the bottom rack of a Kitchen Aid 17A (or equivalent) dishwasher; 10 clean glass tumblers are placed on the top rack. The plates and glasses are then washed with the test liquid or with a commercially available composition as a control detergent. The dishwasher cups are filled half full with the test liquid, amounting to about 29–35 grams. About 29 grams of the commercial powder is used. After each cycle, the plates are re-soiled and the glasses visually inspected by an expert comparing them to standard photographs, and placed in a different machine. Each glass gets a numerical rating for spotting and filming, on a scale of 0–4 (0=best, 4=worst) for 4 runs. The values for each glass in each run are averaged together for an overall rating.

| | Control Detergent Composition | |
|---|---|---|
| Example | Spotting | Filming |
| 1 | 1.7 | 1.4 |
| 2 | 1.7 | 1.2 |
| 3 | 2.0 | 1.2 |
| Control | 1.8 | 1.3 |

EXAMPLES 4–6

The following dishwasher liquid compositions are made up:

| | 4 | 5 | 6 |
|---|---|---|---|
| Carboxymethyl Guar Gum | 1.5% | 1.5% | 1.5% |
| Ethanol | 1.5 | 1.5 | 1.5 |
| Polyoxyethylene-polyoxypropylene block copolymer MW = 2500 | 9.0 | 9.0 | 9.0 |
| Polyoxyethylene-polyoxypropylene block copolymer MW = 2000 | 3.0 | 3.0 | 3.0 |
| Na Citrate Dihydrate | 18.0 | 18.0 | 18.0 |
| 8/1 Tetra K/Na pyrophosphate | 17.0 | 17.0 | 17.0 |
| Na Silicate ($SiO_2$ : $Na_2O$ = 2) | 6.0 | 6.0 | 6.0 |
| Urea | 2.4 | 3.2 | 3.2 |
| Glycerol | 2.0 | 0.5 | 1.0 |
| Water | | to 100% | |

Performance tests were carried out as Examples 1–3.

| Example | Spotting | Filming |
|---|---|---|
| 4 | 1.9 | 1.6 |
| 5 | 2.0 | 1.4 |
| 6 | 2.0 | 1.6 |
| Control | 2.4 | 1.0 |

Control Detergent Composition

| | % by Weight |
|---|---|
| Potassium Dichloroisocyanurate | 1.0 |
| Polyoxypropylene-polyoxyethylene Block Copolymer | 0.5 |
| Sodium Tripolyphosphate | 32.3 |
| Sodium Carbonate | 25.4 |
| Sodium Sulfate | 15.8 |
| Sodium Silicate ($SiO_2 : Na_2O = 2.6$) | 13.9 |
| Water | 10.6 |
| Miscellaneous | to 100% |

EXAMPLES 7-12

The following dishwasher liquid compositions are made up. Viscosities were measured with a Brookfield LVF viscometer #4 spindle, 6 rpm, at 25° C., and were taken after one month storage at room temperature.

| | 7 | 8 | 9 | 10 | 11 | 12 |
|---|---|---|---|---|---|---|
| Carboxymethyl Guar Gum | 1.5% | 1.5% | 1.5% | 1.5% | 1.5% | 1.5% |
| Ethanol | 1.5 | 1.5 | 1.5 | 1.5 | 1.5 | 1.5 |
| Polyoxyethylene-polyoxypropylene block copolymer MW = 2500 | 9.0 | 9.0 | 9.0 | 9.0 | 9.0 | 9.0 |
| Polyoxyethylene-polyoxypropylene block copolymer MW = 2000 | 3.0 | 3.0 | 3.0 | 3.0 | 3.0 | 3.0 |
| Na Citrate Dihydrate | 18.0 | 18.0 | 18.0 | 18.0 | 18.0 | 18.0 |
| 8/1 Tetra K/Na pyrophosphate | 17.0 | 17.0 | 17.0 | 17.0 | 17.0 | 17.0 |
| Na Silicate ($SiO_2$:$Na_2O$ = 2) | 6.0 | 6.0 | 6.0 | 6.0 | 6.0 | 6.0 |
| Urea | 2.4 | 2.4 | 2.4 | 3.2 | 3.2 | 3.2 |
| Glycerol | 1.5 | 1.0 | 0.5 | 0.5 | 1.0 | 1.5 |
| Water | | | to 100% | | | |
| Viscosities (cps) | >100,000 | 60,000 | 26,000 | 26,000 | 72,000 | >100,000 |

EXAMPLES 13-16

The following Examples show the use of various substituents in liquid dishwasher compositions. All are thick, stable pastes or gels.

| | 13 | 14 | 15 | 16 |
|---|---|---|---|---|
| Carboxymethyl Guar Gum | 1.5% | — | 1.5% | 1.5% |
| Xanthan Gum | — | 1.8% | — | — |
| Ethanol | — | — | 1.5 | 1.5 |
| Isopropanol | 1.5 | — | — | — |
| Polyoxymethylene-polyoxypropylene block copolymer MW = 2500 | 9.5 | 6.7 | 9.0 | 9.0 |
| Polyoxymethylene-polyoxypropylene block copolymer MW = 2000 | 1.5 | 3.3 | 3.0 | 3.0 |
| Na Citrate Dihydrate | 17.5 | — | 18.0 | 18.0 |
| 8/1 Tetra K/Na pyrophosphate | 1.2 | 30.0 | 17.0 | 17.0 |
| Na Silicate ($SiO_2$:$Na_2O$ = 2.4) | 4.0 | 6.0 | 6.0 | 6.0 |
| Urea | 4.0 | 2.0 | 2.0 | 2.0 |
| Glycerol | 4.0 | 10.0 | — | — |
| K dichloroisocyanurate encapsulated with fatty acids | 1.5 | — | — | — |
| Propylene glycol | — | — | — | 4.0 |
| Ethylene glycol | — | — | 4.0 | — |
| Water | | to 100% | | |

What is claimed is:

1. A liquid automatic dishwasher detergent having a viscosity of about 13,000 cps. to about 150,000 cps. at 25° C., and a pH of about 11 to about 13, comprising (a) a surfactant;

(b) about 10% to about 70% of a detergency builder or detergency builder mixture;

(c) sufficient alkalinity agent to adjust the pH of said detergent to about 11 to about 13;

(d) about 0.5% to about 5% of a thickening agent selected from the group consisting of polygalactomannan based polysaccharide gums and derivatives thereof, biopolymeric gums formed by fermentation of glucose, gum tragacanth, starch, dextrin, methyl vinyl ether and maleic anhydride copolymers, and mixtures thereof;

(e) about 0.3% to about 10% of a polyhydric alcohol selected from the group consisting of glycerol, ethylene glycol, propylene glycol, and mixtures thereof;

(f) about 0.5% to about 8% urea; and (g) water.

2. A composition as in claim 1 wherein said thickening agent is guar gum, carboxymethyl guar gum, hydroxyalkyl guar gum, or Xanthan gum.

3. A composition as in claim 1 wherein said surfactant is a nonionic at a level of about 1% to about 25%.

4. A composition as in claim 1 wherein said polyhydric alcohol is glycerol.

5. A composition as in claim 1 having a viscosity of about 15,000 cps. to about 50,000 cps.

6. A composition as in claim 2 wherein said thickening agent is carboxymethyl guar gum at a level of about 1.25% to about 2.5%.

7. A composition as in claim 3 wherein and nonionic is a block copolymer of oxyethylene and oxypropylene at a level of about 3% to about 15%.

8. A composition as in claim 4 wherein said glycerol is present at a level of about 0.3% to about 4.0%.

9. A composition as in claim 1, consisting essentially of:

(a) about 1.5% carboxymethyl guar gum;

(b) about 12% of block copolymers of oxyethylene and oxypropylene having molecular weights of about 2,000 to about 2,500;

(c) about 18% sodium citrate dihydrate;

(d) about 17% 8/1 tetra Na/K pyrophosphate;

(e) about 6% sodium silicate having a $SiO_2$:$Na_2O$ ratio of about 2 to about 2.4;

(f) about 2.4% to about 3.2% urea;

(g) about 1% to about 2% glycerol; and (h) water wherein the ratio of said glycerol to said urea is about 1:3 to about 6:1.

* * * * *